US007652247B2

(12) United States Patent
Lee et al.

(10) Patent No.: US 7,652,247 B2
(45) Date of Patent: Jan. 26, 2010

(54) AERODYNAMIC LENS

(75) Inventors: Dong-Geun Lee, Pusan (KR); Kwang-Seung Lee, Jinhae-si (KR)

(73) Assignee: Pusan National University Industry-University Cooperation Foundation, Pusan (KR)

( * ) Notice: Subject to any disclaimer, the term of this patent is extended or adjusted under 35 U.S.C. 154(b) by 0 days.

(21) Appl. No.: 12/326,164

(22) Filed: Dec. 2, 2008

(65) Prior Publication Data

US 2009/0190122 A1 Jul. 30, 2009

(30) Foreign Application Priority Data

Jan. 24, 2008 (KR) ..... 10-2008-007629

(51) Int. Cl.
*H05H 3/00* (2006.01)

(52) U.S. Cl. ..... 250/251; 250/281; 250/282; 250/288; 95/267; 95/272; 55/442; 55/445

(58) Field of Classification Search ..... 250/251, 250/281, 282, 288; 95/267, 272; 55/442, 55/445

See application file for complete search history.

(56) References Cited

U.S. PATENT DOCUMENTS

2008/0022853 A1* 1/2008 Ariessohn ..... 95/267

OTHER PUBLICATIONS

Wang et al., "Aerodynamic Focusing of Nanoparticles: I. Guidelines for Designing Aerodynamic Lenses for Nanoparticles," Aerosol Science and Technology, vol. 39, pp. 611-623 (2005).
Wang et al., "Aerodynamic Focusing of Nanoparticles: II. Numerical Simulation of Particle Motion Through Aerodynamic Lenses," Aerosol Science and Technology, vol. 39, pp. 624-636 (2005).

* cited by examiner

*Primary Examiner*—David A Vanore
*Assistant Examiner*—Michael Maskell
(74) *Attorney, Agent, or Firm*—Stein McEwen, LLP

(57) ABSTRACT

An aerodynamic lens, comprises a cylindrical body having an inlet and an outlet; and a convergence-divergence lens portion inside the cylindrical body, having a lens hole formed at the center of the convergence-divergence lens portion, through which a carrier gas and particles pass, a convergence slant surface at a convergence angle (α) with a central axis of the aerodynamic lens at the front of the lens hole, and a divergence slant surface at a divergence angle (β) with the central axis of the aerodynamic lens at the rear of the lens hole.

6 Claims, 4 Drawing Sheets

AERODYNAMIC LENS

CROSS-REFERENCE TO RELATED APPLICATIONS

This application claims the benefit of Korean Application No. 2008-7629, filed Jan. 24, 2008, in the Korean Intellectual Property Office, the disclosure of which is incorporated herein by reference.

BACKGROUND OF THE INVENTION

1. Field of the Invention

The present invention relates to an aerodynamic lens, and more particularly to an improved aerodynamic lens capable of effectively focusing fine nano particles having a size of 5~50 nm in air.

2. Description of the Related Art

Generally, an aerodynamic lens focuses particles floating in the atmosphere so as to make a particle beam, and it is adopted as an inlet of a device such as a single-particle mass spectrometer (SPMS).

As well known, the single-particle mass spectrometer analyzes chemical composition and size of a single aerosol particle.

The aerodynamic lens is used in an in-situ particle monitor (ISPM) which is able to measure particles in a vacuum in real time using light scattering of particles in order to control the pollutant in a workplace so as to enhance a production efficiency of semiconductors.

Also, the aerodynamic lens is used to project a particle beam to a target so as to deposit an article of micro-nano scale.

The conventional aerodynamic lens, as shown in FIG. 1, includes a plurality of orifices 1 arranged in a row to thereby focus aerosol particles into a beam.

However, the conventional aerodynamic lens is limited to focus particles only having a size of more than 50 nm and hundreds of nano meters.

In order to solve the above problem, Wang and his colleagues have suggested a method of focusing particles having a size of 3~30 nm using gases of low density such as helium (He). [Wang, X., Kruis, F. E. and McMury, P. H., 2005a, "Aerodynamic Focusing of Nanoparticles: I. Guidelines for designing Aerodynamic Lenses for Nanoparticles," Aerosol Sci. Techno., Vol. 39, pp. 611-623]

However, since the aerodynamic lens seeks for analysis of aerosol particles in atmosphere, introduction of helium to the system is not preferable. In addition, the size of the focused beam is more than 2 mm which is not suitable for analysis of particles. Also, the single-particle mass spectrometer should have a very complicated configuration to handle helium.

Another problem of the conventional aerodynamic lens is that it involves serious vortex. In FIG. 2, (a) illustrates a simulation of flow in case that the flow rate of He is 100 sccm and the inner diameter of the orifice (see 1 of FIG. 1) is 1.3 mm. As shown in the drawing, a vortex is generated behind the orifice, which prevents uniform focusing of particles.

In FIG. 2, (b) shows the stream of gas flow wherein helium is replaced with air as a carrier gas. In this case, the vortex behind the orifice is severer

SUMMARY OF THE INVENTION

The present invention is designed to solve the problems of the prior art, and therefore it is an object of the present invention to provide an aerodynamic lens capable of effectively focusing fine particles equal to or smaller than 50 nm, more preferably, having a size in the range of 5~50 nm.

In order to accomplish the above objective, the present invention provides an aerodynamic lens, comprising: a cylindrical body having an inlet and an outlet; and a convergence-divergence lens portion inside the cylindrical body, having a lens hole formed at the center of the convergence-divergence lens portion, through which a carrier gas and particles pass, a convergence slant surface at a convergence angle ($\alpha$) with a central axis of the aerodynamic lens at the front of the lens hole, and a divergence slant surface at a divergence angle ($\beta$) with the central axis of the aerodynamic lens at the rear of the lens hole.

Preferably, the convergence angle ($\alpha$) is $40° \leqq \alpha \leqq 75°$.

More preferably, the convergence angle ($\alpha$) is $\alpha=45°$.

Also, the divergence angle ($\beta$) is $10° \leqq \beta \leqq 15°$, preferably, $\beta=15°$.

According to the present invention, a nozzle is formed at the outlet of the body.

An aerodynamic lens according to the present invention effectively focuses nano particles less than 50 nm, more preferably, fine nano particles of 5~50 nm.

Also, the aerodynamic lens of the present invention is very practical because it uses air as a carrier gas instead of special gas such as helium.

Further, the aerodynamic lens of the present invention provides excellent focusing performance and transmission efficiency.

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Figure 1:
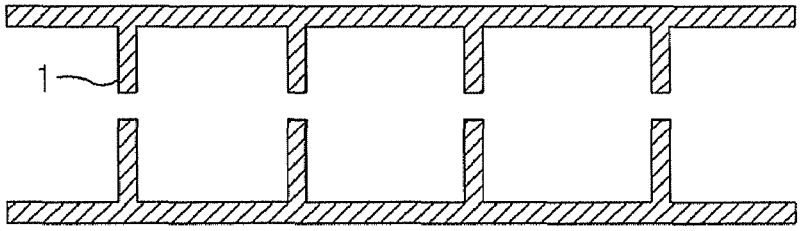
FIG. 1 is a sectional view showing a configuration of the conventional aerodynamic lens.
Figure 2:
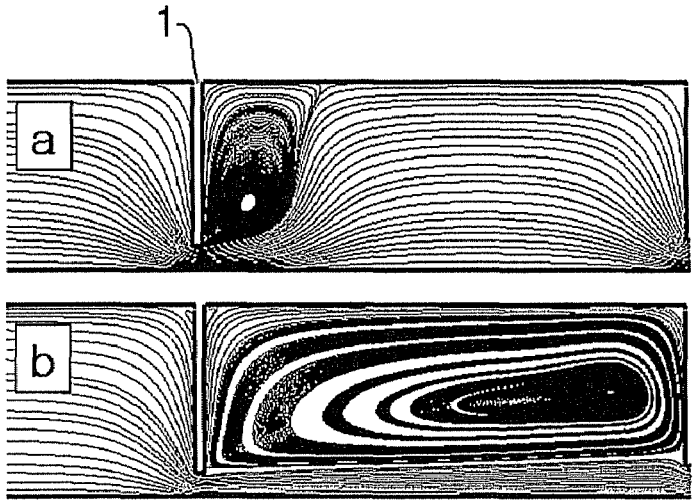
FIG. 2 is a view showing a stream of gas flow of the conventional aerodynamic lens.
Figure 3:
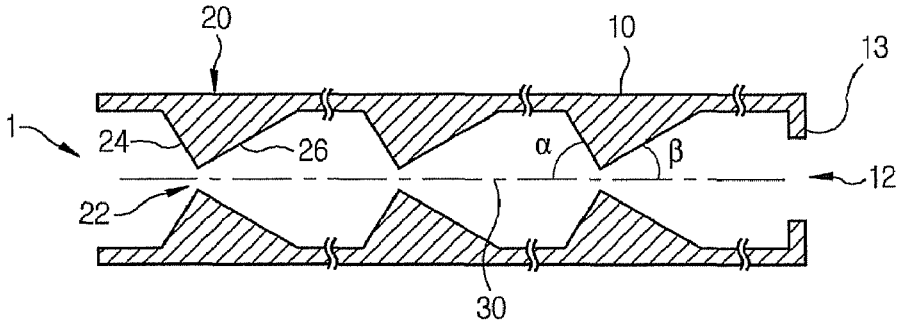
FIG. 3 is a sectional view illustrating convergence-divergence typed aerodynamic lens according to the preferred embodiment of the present invention.

FIG. 3 is a sectional view schematically showing a convergence-divergence typed aerodynamic lens according to the preferred embodiment of the present invention.

Referring to the drawing, the aerodynamic lens of the invention comprises a cylindrical body 3 having an inlet 11 and outlet 12, and a plurality of convergence-divergence lens portion 20.

The inlet 11 leads to an atmosphere to be measured, and the outlet 12 is connected to a chamber having a low pressure such as a vacuum chamber of the single-particle mass spectrometer (not shown). Preferably, the outlet 12 may have a nozzle 13.

A lens hole 22 is formed at the center of the convergence-divergence lens portion 22 through which a carrier gas and particles pass.

A convergence slant surface 24 is provided on the front portion of the lens hole 22, and a divergence slant surface 26 is formed on the rear portion of the lens hole 22.

Here, the convergence slant surface 24 and the divergence slant surface 26 are at an angle (α) and (β) with respect to a central axis 30 of the aerodynamic lens, respectively. Hereinafter the angle (α) and (β) are referred as a convergence angle and a divergence angle, respectively.

The number of the convergence-divergence lens portion 20 may be decided appropriately according to property of particles and measuring devices.

The characteristic and effect of the aerodynamic lens of the present invention now will be explained with experiments.

Condition of Simulation

Numerical analysis program of FLUENT (version 6.2.16) is used to simulate the trace of particles in the convergence-divergence typed aerodynamic lens of the present invention.

Interaction of the particles is ignored because the number-concentration is very low. Also, the particles are very small so that they are considered not to affect the flow.

The boundary condition is mass flow inlet, pressure outlet and axisymmetric, and the flow is steady state, compressible, laminar and viscous flow which is analyzed with Navier-Stokes equation.

The end of the nozzle of the aerodynamic lens is connected to a vacuum chamber, the pressure at the outlet is $10^{-3}$ torr (~0.13 pa), and the flow rate of air at the inlet is 100 sccm (mass flow rate of air is $2.042\times10^{-6}$ kg/s). Brownian motion which is significant to very small particles, so that it is included in simulation of particles smaller than 30 nm, but ignored with respect to particles larger than 30 nm. The whole gas flow is considered to be continuum. Also, the result is based on Near-axis condition unless particular remark is made.

Divergence Angle (β)

Figure 4:
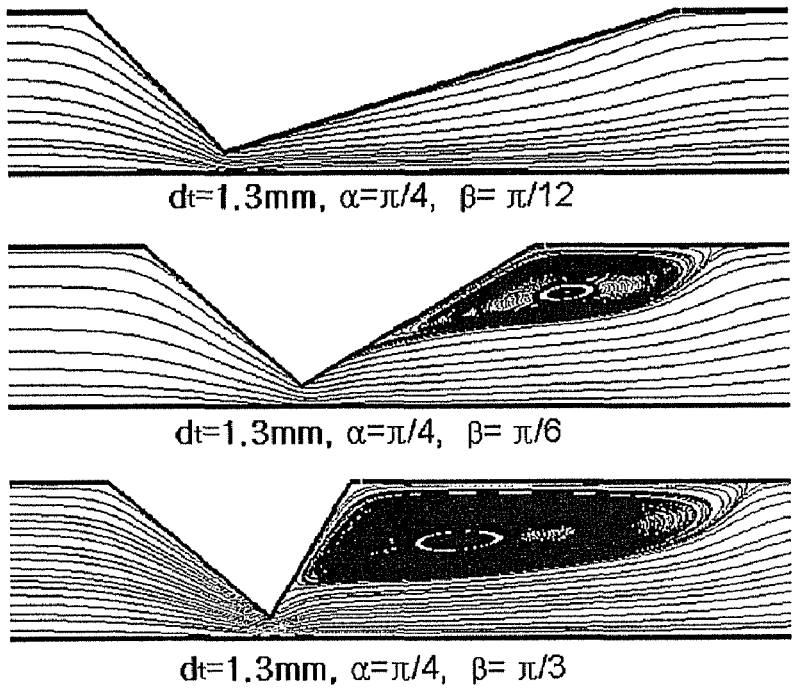
FIG. 4 is a view showing a change of flow depending on a divergence angle ($\beta$) in the present invention.

FIG. 4 shows a stream of flow and vortex depending on a divergence angle (β) with a constant convergence angle (α) of 45°. Here, the diameter ($d_t$) of the lens hole 22 is 1.3 mm.

As shown in the drawing, when the divergence angle (β) is 15°, vortex is not generated and the stream is stable in the rear portion of the convergence-divergence lens portion 20.

On the contrary, when the divergence angle (β) is lager than 15°, vortex increases to result in the same flow as that of the conventional orifice.

Accordingly, the smaller the divergence angle (β) is, the stabler the flow is. However, in case that the divergence angle (β) is extremely small, the divergence slant surface 26 is longer, which results in the increase in the whole length of the aerodynamic lens.

Considering the above, it is preferable that the divergence angle (β) is in the range of $10°\leqq\beta\leqq15°$, more preferably, $\beta=15°$.

Convergence Angle (α)

Figure 5:
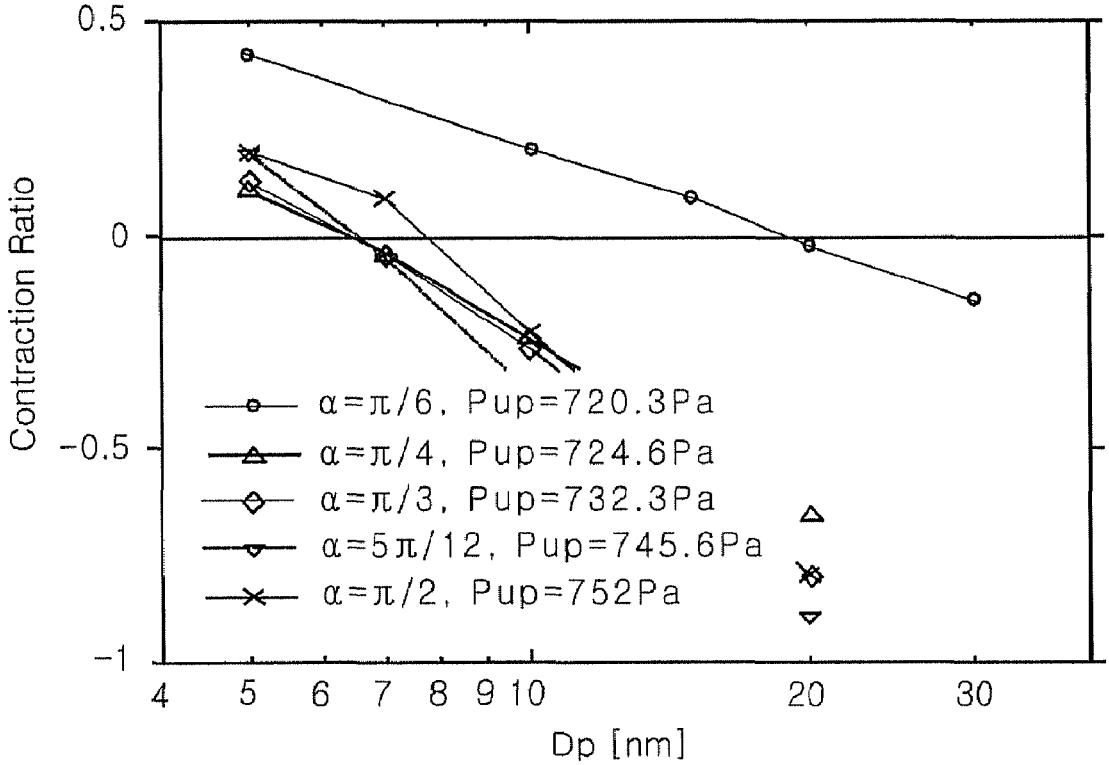
FIG. 5 is a view showing a change of contraction ratio depending on a convergence angle ($\alpha$) in the present invention.

FIG. 5 shows the characteristic of focusing according to the convergence angle (α) of the convergence-divergence lens portion 20. As shown in the drawing, when the diameter ($D_P$) of particles is 5~10 nm, the contraction ratio is 0~0.2 with convergence angle (α) of 45°~75°. Particularly, the slope is gentle to have a maximum contraction ratio at the convergence angle (α) of 45°.

Here, the contraction ratio is obtained by dividing a beam diameter of focused particles by an initial beam diameter of incident particles wherein as the contraction ratio close to zero, focusing ratio is high. If the particles are over-focused, the contraction ratio becomes negative.

Considering the above, the convergence angle (α) is preferably in the range of $40°\leqq\alpha\leqq75°$, more preferably $\alpha=45°$.

Transmission Efficiency

Transmission efficiency is one of the important factors analyzing the performance of the aerodynamic lens together with the contraction ratio as set forth above.

Figure 6:
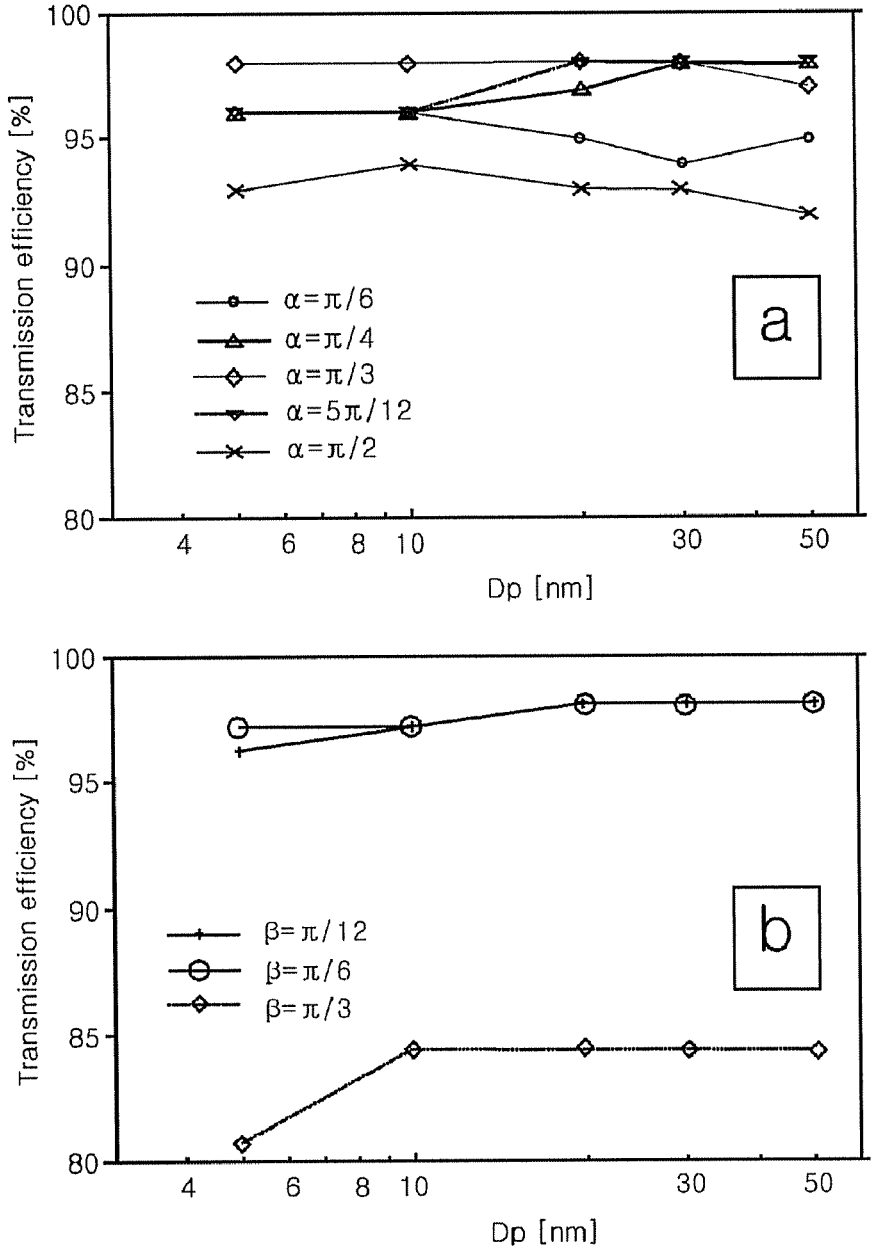
FIG. 6 is a view showing transmission efficiency of the convergence-divergence typed aerodynamic lens according to the preferred embodiment of the present invention.

FIG. 6 illustrates simulation of transmission efficiency according to a size of particle at a single lens portion.

In FIG. 6, (a) shows transmission efficiency varying as the change of the convergence angle (α) with a constant divergence angle (β), wherein the transmission efficiency is somewhat low at an angle $\alpha=30°$ and $\alpha=90°$, but the transmission efficiency becomes higher, i.e., more than 95% at the rest of the angle.

Likewise, (b) of FIG. 6 illustrates transmission efficiency varying as the change of the divergence angle (β) with a constant convergence angle (α), wherein the transmission efficiency is excellent, i.e., more than 95% at the low divergence angle (β), but the transmission efficiency deteriorates less than 80% at the divergence angle $\beta=60°$, which is due to the fact that vortex is severe in the rear portion of the lens portion 20 when the divergence angle (β) increases.

Length of Spacer

A spacer $L_S$ is required to make a fully developed flow for multi-lens by assembling a plurality of lens.

Figure 7:
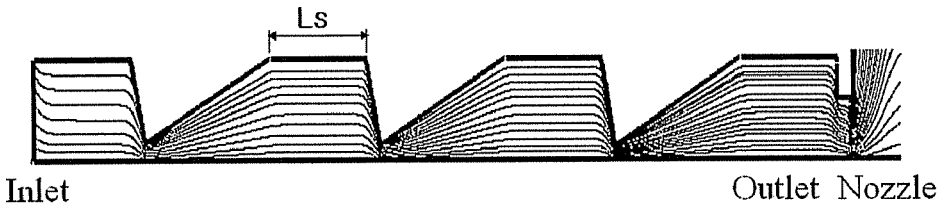
FIG. 7 is a view showing a stream of gas flow of the convergence-divergence typed aerodynamic lens according to the preferred embodiment of the present invention, wherein a half of the aerodynamic lens is illustrated.

According to the present invention, the flow in the lens is very stable as shown in FIG. 7, so that the length of the spacer $L_S$ become relatively short compared to that of the conventional aerodynamic lens.

Comparison with Prior Art

Figure 8:
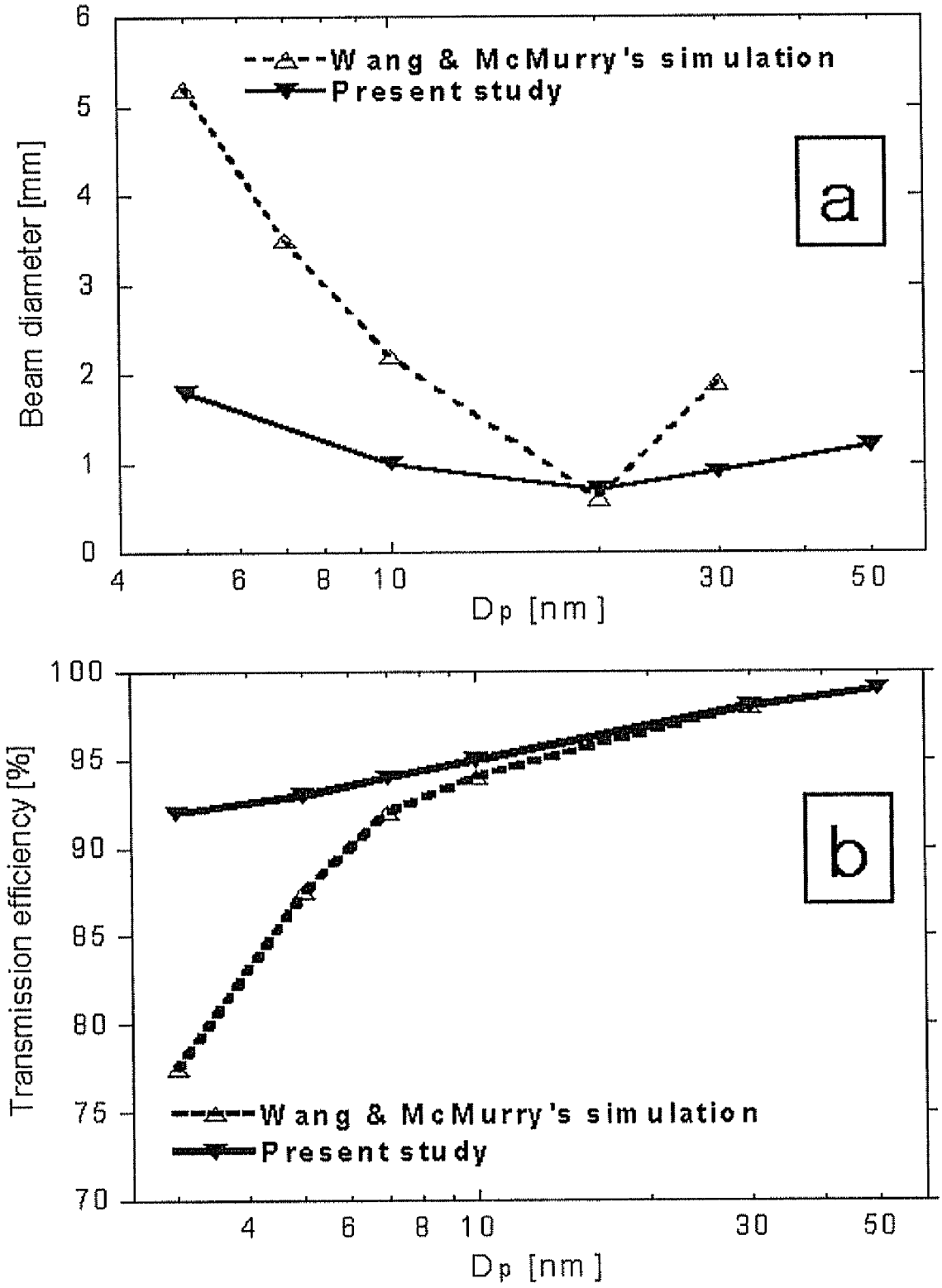
FIG. 8 is a graph showing a focusing performance and transmission efficiency of the convergence-divergence typed aerodynamic lens according to the preferred embodiment of the present invention.

FIG. 8 is a graph wherein the performance of the aerodynamic lens of the present invention adopting air as a carrier gas is compared with Wang's.

Referring to (a) of FIG. 8 showing a beam diameter of focused particles, the aerodynamic lens of the present invention has the same focusing performance as Wang's at the particle size of about 20 nm, but the focusing performance of the invention is superior to Wang's in the range of 5~50 nm except for 20 nm.

In FIG. 8, (b) shows transmission efficiency, wherein the aerodynamic lens of the present invention has better transmission efficiency than the convention aerodynamic lens because the flow is more stable than the conventional orifice typed lens. Particularly, the present invention has transmission efficiency more than 90% with respect to fine particles even having a diameter of 5 nm.

What is claimed is:

1. An aerodynamic lens, comprising:

a cylindrical body having an inlet and an outlet; and a convergence-divergence lens portion inside the cylindrical body, having a lens hole formed at the center of the convergence-divergence lens portion, through which a carrier gas and particles pass, a convergence slant surface at a convergence angle (α) with a central axis of the aerodynamic lens at the front portion of the lens hole, and a divergence slant surface at a divergence angle (β) with the central axis of the aerodynamic lens at the rear portion of the lens hole.

2. The aerodynamic lens according to claim 1, wherein the convergence angle (α) is $40° \leqq \alpha \leqq 75°$.

3. The aerodynamic lens according to claim 2, wherein the convergence angle (α) is $\alpha = 45°$.

4. The aerodynamic lens according to claim 1, wherein the divergence angle (β) is $10° \leqq \beta \leqq 15°$.

5. The aerodynamic lens according to claim 4, wherein the divergence angle (β) is $\beta = 15°$.

6. The aerodynamic lens according to claim 1, wherein a nozzle is formed at the outlet of the body.

* * * * *